US007836740B2

(12) United States Patent
Launius, Jr.

(10) Patent No.: US 7,836,740 B2
(45) Date of Patent: Nov. 23, 2010

(54) AXLE STRAIGHTENING PRESS

(76) Inventor: William E. Launius, Jr., 100 E. Laurel Ave., Millstadt, IL (US) 62260

( * ) Notice: Subject to any disclaimer, the term of this patent is extended or adjusted under 35 U.S.C. 154(b) by 607 days.

(21) Appl. No.: 11/749,513

(22) Filed: May 16, 2007

(65) Prior Publication Data

US 2007/0209422 A1 Sep. 13, 2007

Related U.S. Application Data

(63) Continuation-in-part of application No. 11/304,244, filed on Dec. 15, 2005, now abandoned.

(51) Int. Cl.
*B21D 37/10* (2006.01)
*B21C 51/00* (2006.01)

(52) U.S. Cl. ..... 72/31.03; 72/470; 72/416

(58) Field of Classification Search ..... 72/31.03, 72/360, 374, 456, 470, 411–417, 76, 467, 72/316, 317, 367.1, 370.02, 370.04, 370.1, 72/370.12, 370.13, 370.23–370.25, 478, 72/472, 705

See application file for complete search history.

(56) References Cited

U.S. PATENT DOCUMENTS

| | | | | | |
|---|---|---|---|---|---|
| 164,187 | A * | 6/1875 | Knowles | 72/90 |
| 338,502 | A * | 3/1886 | Gerald | 72/355.2 |
| 1,051,777 | A * | 1/1913 | St. Mars | 72/416 |
| 1,399,101 | A | 12/1921 | Bowman | |
| 1,889,775 | A * | 12/1932 | Cornell, Jr. | 72/478 |
| 1,919,254 | A * | 7/1933 | Picece et al. | 72/77 |
| 2,278,293 | A * | 3/1942 | Watson | 72/316 |
| 2,791,259 | A * | 5/1957 | Griglak | 72/411 |
| 2,793,859 | A | 5/1957 | Darling | |
| 3,234,838 | A * | 2/1966 | Faull | 83/454 |
| 3,776,019 | A | 12/1973 | Shaw | |
| 3,803,897 | A * | 4/1974 | Ridenour et al. | 72/412 |
| 3,881,341 | A | 5/1975 | Evans | |
| 3,992,918 | A | 11/1976 | Broyles | |
| 3,998,083 | A | 12/1976 | Dilling | |
| 4,116,037 | A | 9/1978 | Honeycutt | |
| 4,412,565 | A | 11/1983 | Bronberg | |
| 4,891,877 | A * | 1/1990 | Talavera | 29/237 |
| 5,161,584 | A | 11/1992 | Krainaker | |
| 5,526,670 | A * | 6/1996 | Parola | 72/416 |
| 5,941,118 | A * | 8/1999 | Tseng | 72/370.04 |
| 6,234,000 | B1 | 5/2001 | Bowling | |
| 6,604,403 | B1 * | 8/2003 | Eslambolchi et al. | 72/416 |
| 2004/0050135 | A1 * | 3/2004 | Launius, Jr. | 72/416 |
| 2006/0090536 | A1 * | 5/2006 | Launius, Jr. | 72/416 |

* cited by examiner

*Primary Examiner*—Dana Ross
*Assistant Examiner*—Pradeep C Battula
(74) *Attorney, Agent, or Firm*—Charles McCloskey

(57) ABSTRACT

The axle straightening press has a female jaw and a male jaw each with a rectangular shape, a mating surface, and a transverse half channel. The dowels of the male jaw fit into holes in the female jaw upon a diagonal line on the mating surface. Preferably, the press has two identical jaws, inverted, and closed upon each other. Each jaw has a generally rectangular shape with a mating surface, a dowel, a transverse half channel, and a hole. The half channel is less than one tenth the thickness of said jaw and has flared ends for shaping the head of an axle into a cone. A Cub Scout places an axle in the channel between the jaws and strikes the press with a hammer. Removing the axle from the press, the Cub Scout places a wheel on the axle, and installs the axle upon a model car.

4 Claims, 6 Drawing Sheets

AXLE STRAIGHTENING PRESS

CROSS REFERENCE TO RELATED APPLICATION

This application is a continuation in part application of the non-provisional application Ser. No. 11/304,244 filed on Dec. 15, 2005 now abandoned which claims priority to the non-provisional application Ser. No. 10/658,068 filed on Sep. 9, 2003 which claims priority to the provisional application Ser. No. 60/411,635, filed on Sep. 18, 2002, the disclosures of which are herein incorporated by reference, and the aforesaid applications are commonly owned by the same inventor.

BACKGROUND OF THE INVENTION

The present invention relates to an axle straightening press for use as a hand tool in connection with model cars. The axle straightening press has particular utility in connection with straightening axles.

As winter loosens its grip, Cub Scouts emerge from dens across the land for a contest: the PINEWOOD DERBY® wooden model car race. For the PINEWOOD DERBY® wooden model car race, Cub Scouts and their adult sponsors assemble a wooden car from a kit and then race their cars against those of fellow Cub Scouts upon a track with guideways for each car. Cub Scouts that win local races advance to tournaments. In a car race, speed remains essential to victory and thousandths of a second count. Cub Scouts and sponsors seek to minimize wheel friction and to align wheels precisely. The wood cars have four wheels. Each plastic wheel has a finished face, a rim, and a centered hub opposite the finished face. The hub fits over an axle hammered into the car. Spinning upon the axle, the hub contacts the car.

A unique aspect of the present invention is straightening an axle manually with minimal risk of injury and only a hammer. In a press, an axle straightens under a compressive force uniformly applied. A straight axle parallels the axis of rotation of the wheel allowing the wheel complete contact with the track and not the guideway. Prior art designs straightened axles by visual and tactile observation alone. Because of imprecise hammering and sore thumbs, Cub Scouts had less involvement in fine-tuning the axles for their cars and slower cars. In summary, the prior art required a hammer and the coordination of an adult while Cub Scouts sat out the fine-tuning of their cars for speed.

The present art overcomes the limitations of the prior art. The difficulty in straightening axles by Cub Scouts with minimal injury is shown by the operation of the typical method. From the factory and handling, axles have slight imperfections. Installed upon a car, an as delivered axle may cause binding of the hub and will alter the toe and camber of the wheel adversely. The wheel makes partial contact with the track and the guideway, increasing friction and reducing the speed of the car. Typically, sponsors and Cub Scouts straighten axles by hand and eye with a hammer. A sponsor would roll an axle upon a flat surface until the axle rotated longitudinally to its highest point. Then to straighten the axle, a conventional method requires a sponsor to hold the axle at its highest point and then to hit the highest point with a hammer. Such a manual method may not accurately straighten the hub and result in injuries to fingers and thumbs. The present invention overcomes this difficulty.

That is, the art of the present invention allows Cub Scouts to straighten the axles of their model cars using a blow or two from a hammer. Axle straightening presses are desirable to reduce friction between a hub and an axle, and for a more precise orientation of a rim to the track.

DESCRIPTION OF THE PRIOR ART

The use of wire straighteners, akin to the present invention, is known in the prior art. For example, U.S. Pat. No. 1,399,101 to Bowman does show one jaw registering with another jaw using cooperating holes and dowels. The Bowman patent teaches of two jaws tethered by a chain in registry with dowels and holes. However, one Bowman jaw is bolted to a machine base whereas the jaws of the present invention are merely placed on a convenient solid surface, such as a basement work bench or floor.

The U.S. Pat. No. 3,234,838 to Faull shows pins cooperating with holes to register two dies. The pins of Faull appear closely located to the edges of the dies as shown in FIG. 2. Faull shows additional bolts 23, 23.1 arrayed on the corners of the dies that fix the dies against translation. When bent tubing is placed into the jaws of Faull with the bend towards a pin, the bolts in combination with the pins prevent the dies from translating and thus force tubing to straighten.

The U.S. Pat. No. 6,234,000 to Bowling teaches of a screw press that straightens a fraction of the length of an aluminum bat, likely hollow. The present invention though straightens the entire length of a solid axle in one operation.

Then U.S. Pat. No. 3,993,918 to Broyles discloses a nail straightener. However, the Broyles '918 patent does not have grooves perpendicular to the direction of the hammer blows, and has further drawbacks of jamming a nail between the wedge and the anvil and of having a solid part and a hollow part.

U.S. Pat. No. 4,116,037 to Honeycutt discloses a tubing sizer and straightener that uses lever action. However, the Honeycutt '037 patent does not have alignment dowels, and cannot operate with hammer blows.

Similarly, U.S. Pat. No. 2,278,293 to Watson discloses a forging apparatus that alters a cylindrical blank into a mandrel with an expanded head. However, the Watson '293 patent does not have alignment dowels, does not hammer perpendicular to the length of the blank, and cannot operate without retaining the dies.

Similarly, U.S. Pat. No. 2,793,859 to Darling et al. discloses a baseball bat and method of making the same. The Darling '859 disclosure shows pins aligning the dies. However, the Darling '859 patent does not operate without heating elements, and cannot compress a nail nor a wooden bat blank in a time period less than 15 minutes.

Similarly, U.S. Pat. No. 5,161,584 to Krainaker et al. discloses a wire straightener for accommodating different size wires. However, the Krainaker '584 patent does not straighten by hammering but rather by drawing of wire, and cannot have flat surface portions on the blocks.

Similarly, U.S. Pat. No. 4,412,565 to Bronberg discloses a wire straightener tool that has ridges perpendicular to a length of wire. However, the Bronberg '565 patent does not straighten by hammering but rather by drawing of wire across the ridges.

Similarly, U.S. Pat. No. 3,998,083 to Dilling discloses a straightening apparatus that advanced the tubing through the apparatus. A belt and pulley power the apparatus. However, the Dilling '083 patent does not straighten by hammering but rather by pushing and rotating the tubing through a joint, and cannot be operated by hand.

Lastly, U.S. Pat. No. 3,881,341 to Evans discloses a bar straightener that operates with lever action. However, the Evans '341 patent does not clamp round bars, and has the additional deficiency of not using hammering to straighten bars.

While the above-described devices fulfill their respective, particular objectives and requirements, the aforementioned patents do not describe an axle straightening press. The Broyles '918 patent makes no provision for grooves perpendicular to the direction of the hammer blows. The Honeycutt '037 patent lacks alignment dowels between jaws. Further, the Watson '293 patent lacks alignment dowels and requires a restraining frame. The Darling '859 patent makes no provision for operation without heating elements. The Krainaker '584, Bronberg '565, and Dilling '083 patents make no provision for hammering wire and tubing. And the Evans '341 patent makes no provision for round bars.

Therefore, a need exists for a new and improved axle straightening press that the present invention substantially fulfills. The axle straightening press according to the present invention substantially departs from the conventional concepts and designs of the prior art, and in doing so provides a device primarily developed for the purpose of straightening axles by children using hand tools with limited adult supervision.

SUMMARY OF THE INVENTION

In view of the foregoing disadvantages inherent in the wire straighteners of the prior art, the present invention provides an improved axle straightening press, and overcomes the above-mentioned disadvantages and drawbacks of the prior art. As such, the general purpose of the present invention, which will be described subsequently in greater detail, is to provide a new and improved axle straightening press which has all of the advantages of the prior art mentioned heretofore and many novel features that result in an axle straightening press which is not anticipated, rendered obvious, suggested, or even implied by the prior art, either alone or in any combination thereof.

To attain this, the present invention essentially comprises a press to straighten axles by hammer blows that has two identical cooperating jaws. Each jaw has a generally rectangular shape, a mating surface, a centered half channel less than 10% of jaw thickness upon the lateral axis of the mating surface, one dowel extending perpendicular to the mating surface on one side of the half channel, and one hole extending perpendicular through the jaw thickness and into the mating surface on the other side of the half channel from the dowel. The dowel of one jaw aligns with the hole of the other jaw, the two jaws close together, and the half channels cooperate to confine an axle.

And in an alternate embodiment, a press to straighten axles by hammer blows has a male jaw and cooperating female jaw. The male jaw has a generally rectangular shape, a mating surface, a centered half channel upon the lateral axis of the mating surface, and at least one dowel extending perpendicular to the mating surface. Then the female jaw has a generally rectangular shape, a mating surface that abuts on a common plane with the male jaw, a centered half channel upon the lateral axis of the mating surface, and at least one hole extending perpendicular and into the mating surface. Aligning the male jaw together with the female jaw, the jaws close, the dowels fit snugly within the holes and the half channels cooperate to confine an axle.

There has thus been outlined, rather broadly, the more important features of the invention in order that the detailed description thereof that follows may be better understood and in order that the present contribution to the art may be better appreciated.

The invention may also include two dowels: of cylindrical shape on opposite sides of a half channel, on a diagonal line, rounded on an end, that extend partially through the jaw thickness, and extend above the mating surface; two holes: of cylindrical shape matching the dowels on opposite sides of a half channel, on a diagonal line, and that extend through the jaw thickness; and on both of two jaws, a dowel and hole pair, with a cylindrical dowel, the dowel and hole located on opposite sides of a half channel, and the hole extending through the jaw thickness. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. Before explaining the current embodiment of the invention in detail, the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved axle straightening press that has all of the advantages of the prior art wire straighteners and none of the disadvantages.

It is another object of the present invention to provide a new and improved axle straightening press that may be easily and efficiently manufactured and marketed.

An even further object of the present invention is to provide a new and improved axle straightening press that has a low cost of manufacture with regard to both materials and labor, and which accordingly is then susceptible of low prices of sale to the consuming public, thereby making such axle straightening press economically available to the Cub Scouts and their sponsors.

Still another object of the present invention is to provide an axle straightening press for straightening axles. A straight axle precisely positions a spinning wheel for a flat fit of the wheel rim to the track, reducing friction, and increasing the speed of the car.

Still yet another object of the present invention is to provide an axle straightening press for straightening axles. This makes it possible for a Cub Scout to finish an axle without a power tool.

Still yet another object of the present invention is to provide an axle straightening press for straightening axles. This makes it possible for a Cub Scout to finish an axle with minimal risk of injury and less adult supervision.

Lastly, it is an object of the present invention to provide a new and improved method of straightening an axle for a model car typically by a Cub Scout and his sponsor. The method has these steps: 1) assembling one jaw into the second jaw of a press, 2) inserting one or more dowels from one jaw into the other jaw and closing the jaws together, 3) placing the axle into the channel formed between the jaws of the press, 4) locating the press upon a solid surface and striking a jaw of the press repeatedly with a hammer, 5) partially rotating the axle at least twice and repeating placement and hammering of the press, and 6) striking the head of the axle to square it.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
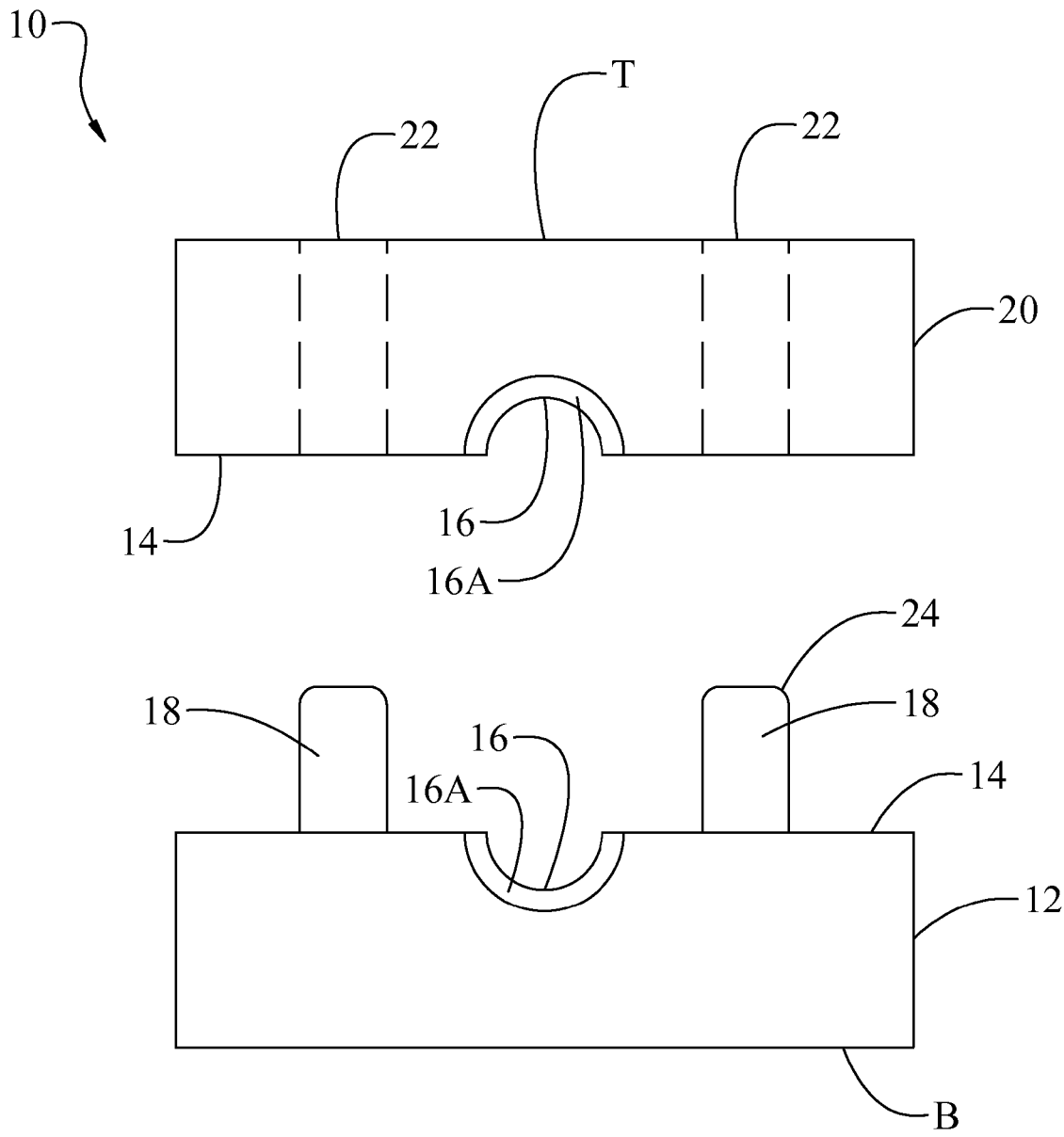
FIG. 1 shows a view of the male and female jaws of the alternate embodiment of the axle straightening press constructed in accordance with the principles of the present invention.

Referring now to the drawings, and particularly to FIGS. 1-5, an axle straightening press of the present invention is shown and generally designated by the reference numeral 10. The present art overcomes the prior art limitations in straightening an axle by a Cub Scout with a hammer at minimal risk of injury. In FIG. 1, a new and improved axle straightening press 10 of the present invention for straightening axles is illustrated and will be described. More particularly, the axle straightening press 10 appears in a view with a female jaw 20 and a male jaw 12. The female jaw 20 has a top surface T generally rectangular in shape with an opposing mating surface 14. The mating surface 14 has a generally rectangular shape with a centered and transverse half channel 16 in the mating surface 14. The half channel 16 has a semi-circular cross section on a plane parallel to the longitudinal axis of the mating surface 14. The half channel 16 has its diameter coplanar with the mating surface 14 and its depth extending toward the top surface T. The half channel has a depth less than 10% of the thickness of the jaw 20.

Opposite the female jaw 20, the axle straightening press 10 has a male jaw 12. The male jaw 12 has a bottom surface B generally rectangular in shape with an opposing mating surface 14. The mating surface 14 has a generally rectangular shape with a centered and transverse half channel 16 in the mating surface 14. The half channel 16 has a semi-circular cross section on a plane parallel to the longitudinal axis of the mating surface 14. The half channel 16 has its diameter coplanar with the mating surface 14 and its depth extending toward the bottom surface B. Here, the half channel has less than 10% of the thickness of the jaw 12, and preferably less than 8% of thickness. Extending away from the mating surface 14, two dowels 18 have a round cross section and generally cylindrical shape. The two dowels 18 are located along a diagonal line upon the mating surface 14 so that the dowels 18 are not opposite of each other on both the transverse and longitudinal axes of the mating surface 14. Opposite the mating surface 14, the dowels 18 have a rounded end 24 to ease insertion into the holes 22. The dowels have a height above the mating surface generally the same as the thickness of the jaw for complete insertion into the cooperating holes.

Figure 2:
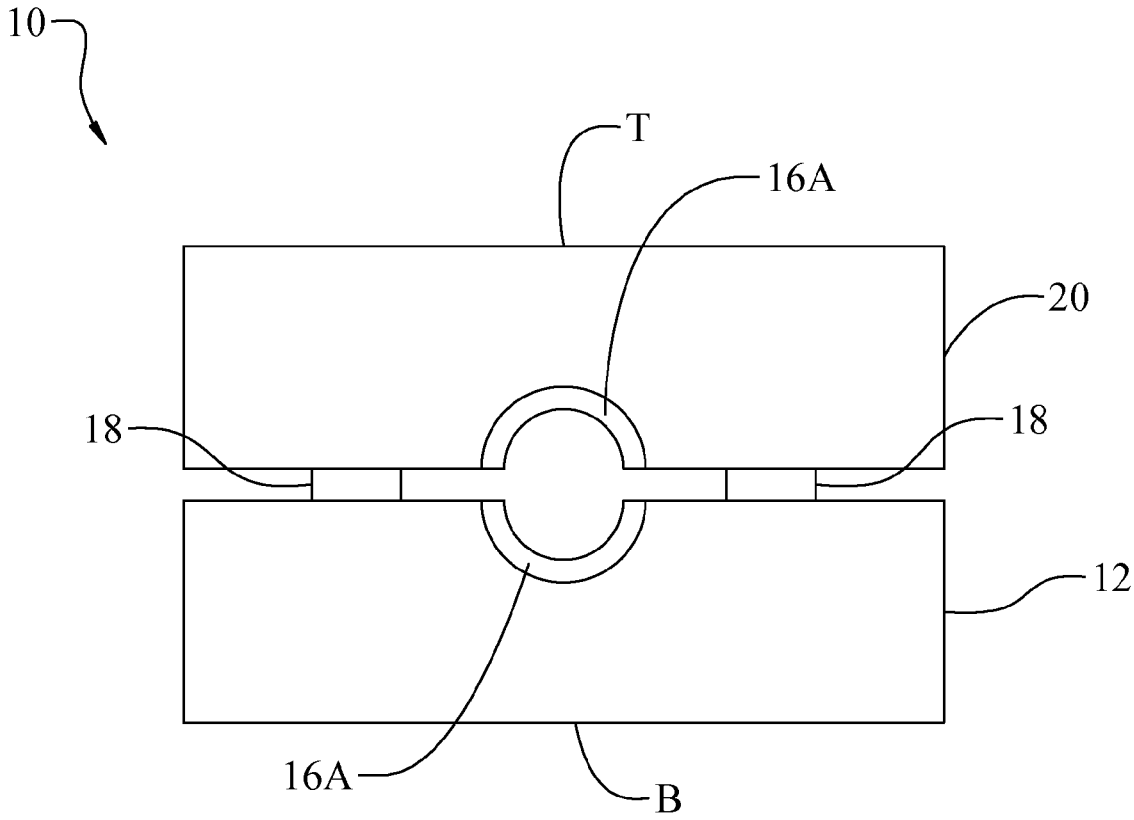
FIG. 2 shows a front view of the assembled jaws of the axle straightening press.

Turning to FIG. 2, the dowels 18 of the male jaw 12 insert into matching holes 22 in the female jaw 20. The half channels 16 of the male jaw 12 and the female jaw 20 come together and form a channel, round in cross section, slightly less than the diameter of an axle. The dowels 18 of the male jaw 12 fit snugly into holes 22 in the female jaw 20.

Figure 3:
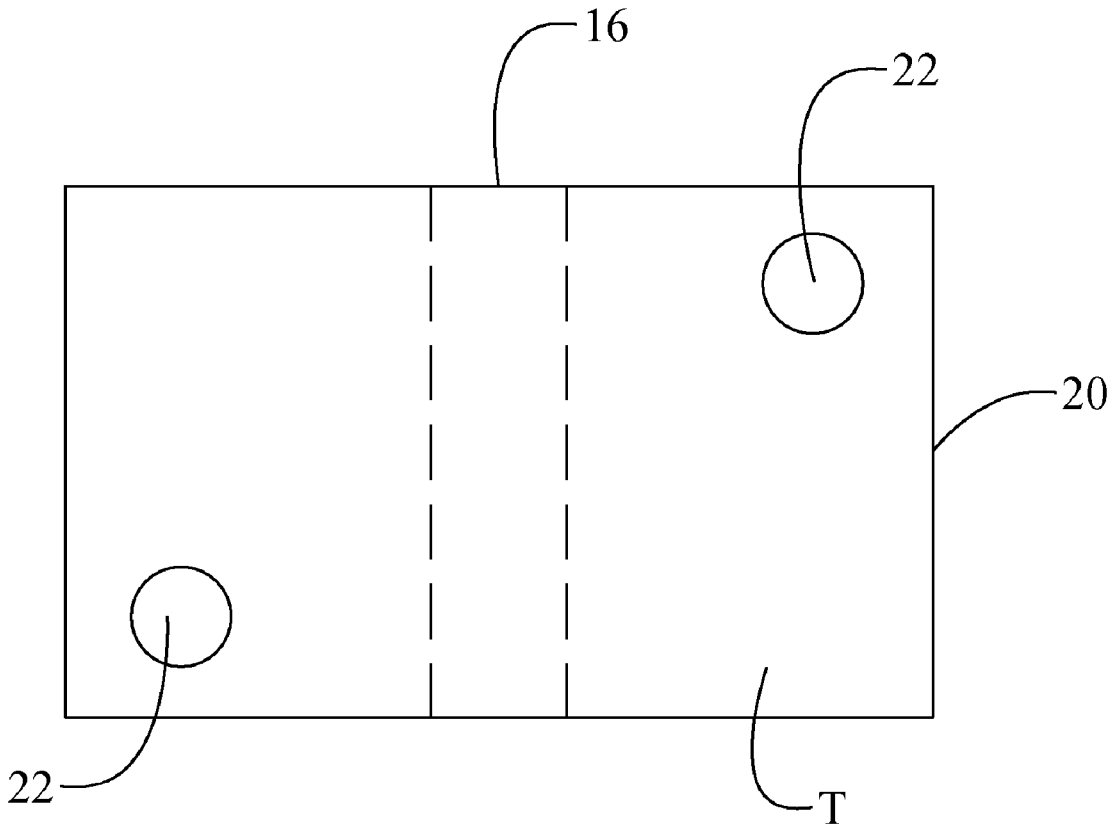
FIG. 3 shows a top view of the female jaw of the axle straightening press.

FIG. 3 shows the holes 22 in the female jaw 20 that pass through the depth of the female jaw 20. The holes 22 have a cooperating shape, here round, that fits the dowels 18. The holes 22 are located along a diagonal line upon the mating surface 14 and top surface T so that the holes 22 are not opposite of each other on both of the transverse and longitudinal axes of the mating surface 14 and top surface T. The channel is perpendicular to the longitudinal axes of the holes 22 and the dowels 18. The dowels 18 and holes 22 have a matching regular spacing along a diagonal line upon the mating surface 14.

Figure 4:
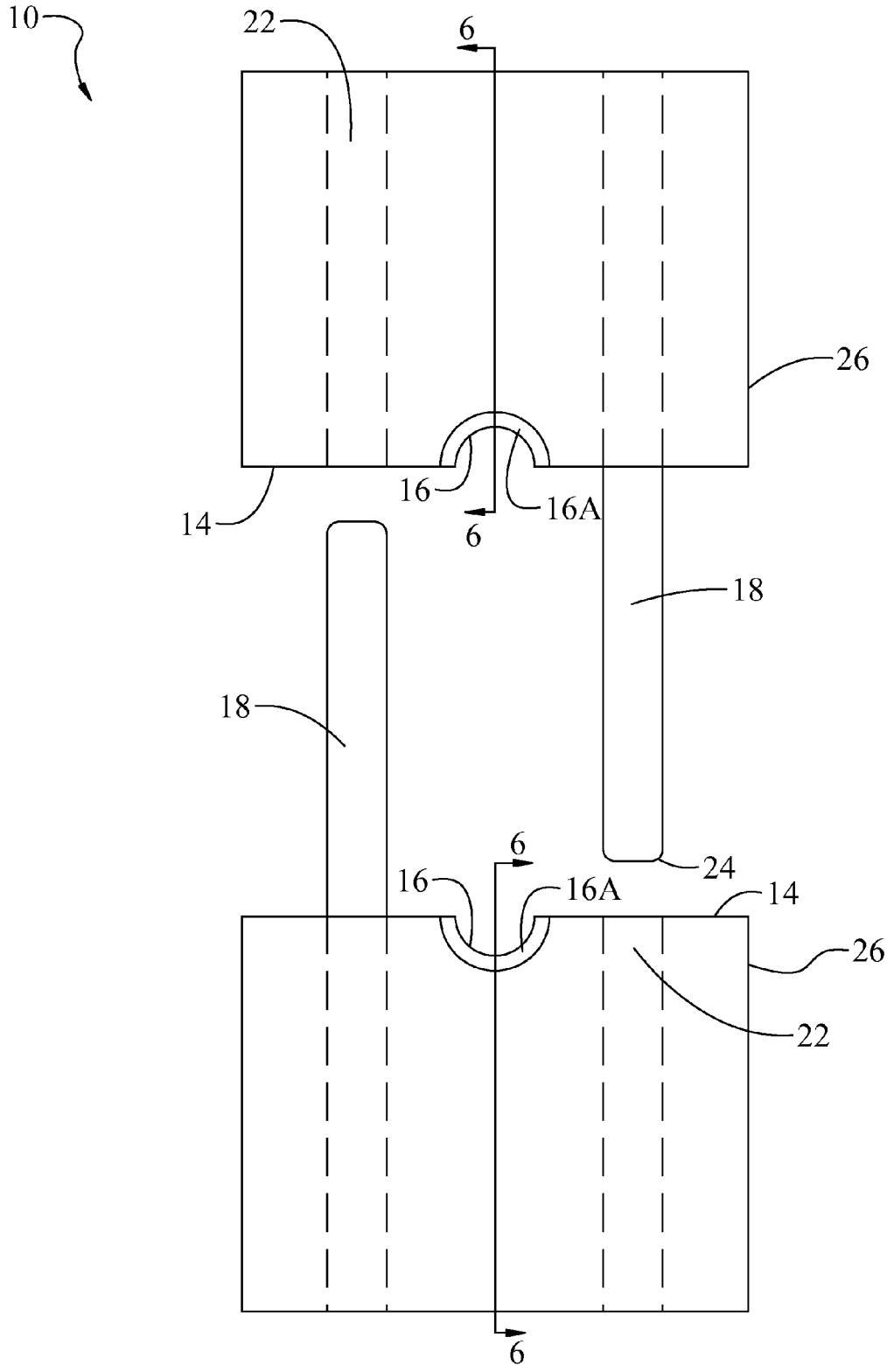
FIG. 4 shows a view of the preferred embodiment of the two identical jaws of the axle straightening press.

In FIG. 4, the preferred embodiment of the axle straightening press 10 is illustrated in an enlarged view highlighting the shallow depth of the half channel compared to the jaw thickness. More particularly, the axle straightening press 10 appears in a view with two similar jaws 26. Each jaw 26 has a generally rectangular shape and a mating surface 14. The mating surface 14 has a generally rectangular shape with a centered and transverse half channel 16 machined into the mating surface 14. The half channel 16 has a semi-circular cross section on a plane parallel to the longitudinal axis of the mating surface 14. The half channel 16 has its diameter coplanar with the mating surface 14 and its depth extending toward the top surface T. In a preferred embodiment, the half channel has a diameter less than one tenth of the thickness of the jaw, preferably less than 8% of thickness. Additionally, the half channel 16 in each jaw has a countersink or flare, as at **16*a***, upon each end. The flare allows for coning of the head of an axle for less surface contact of the head with the wheel and thus a faster wheel.

Extending away from the mating surface 14, a dowel 18 has a round cross section and generally cylindrical shape. The dowel 18 is located symmetrically opposite the hole 22 with the dowel 18 on one side of the half channel 16 and the hole 22 on the other side. Opposite the mating surface 14, the dowels 18 have a rounded end 24 to ease insertion into the holes 22. The dowels have a height above the mating surface generally the same as the thickness of the jaw and the dowel 18 of one jaw 26 inserts into a matching hole 22 in a second jaw 26. The hole here extends through the thickness of the jaw. To simplify manufacturing of each jaw, the holes upon both sides of the half channel are the same diameter and length so that a dowel may be inserted in either hole. The jaw thickness provides sufficient rigidity for the jaw to withstand hammer blows with a full depth hole. The half channels 16 of the two jaws 26 come together and form a channel, round in cross section, slightly less than the diameter of an axle. The dowels 18 of the jaws 26 fit snugly into the holes 22.

Figure 5:
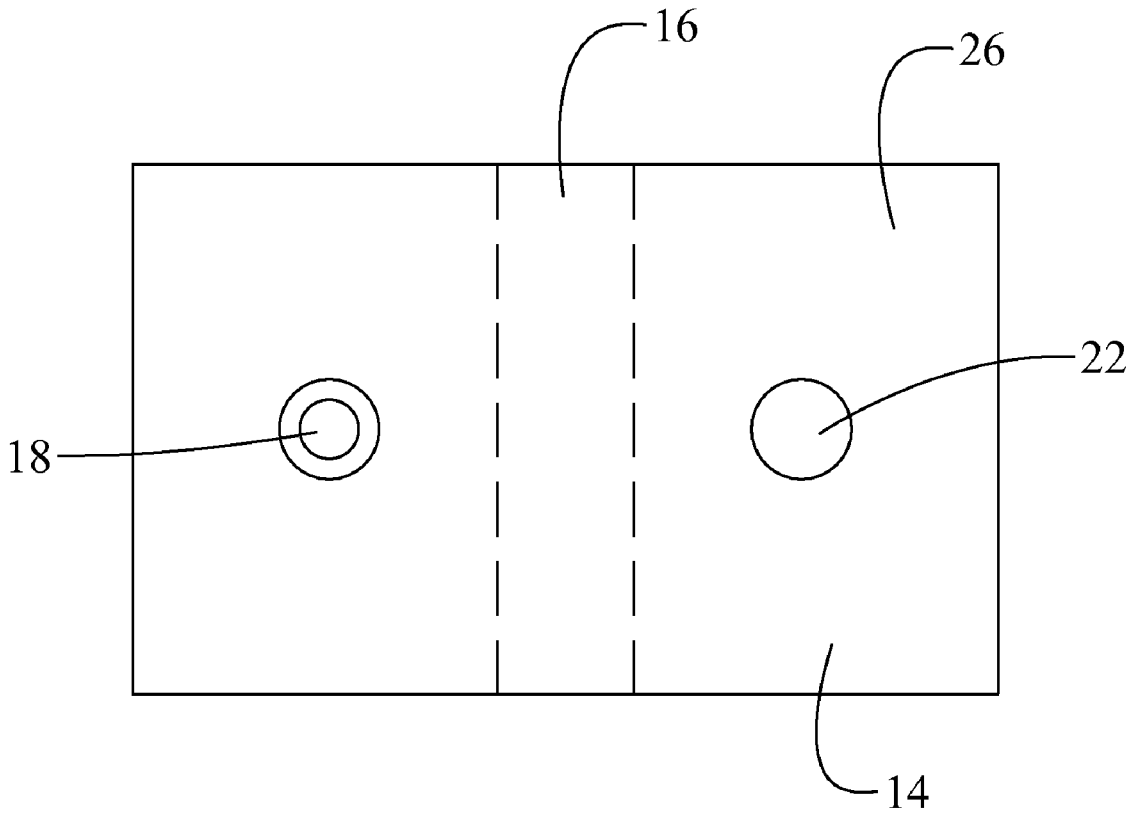
FIG. 5 shows a top view of a similar jaw of the axle straightening press; and, FIG. 6 shows a sectional view through the half channel of the preferred embodiment.

Turning to FIG. 5, the similar jaws 26 each have a hole 22 and a dowel 18. The hole 22 in the jaw 26 passes through the thickness of the jaw 26 and has a round shape that receives a dowel 18. The hole 22 and dowel 18 are located on opposite sides of the half channel 16 upon the mating surface 14. The half channel 16 is perpendicular to the longitudinal axes of the holes 22 and the dowels 18. The dowels 18 and holes 22 have a matching regular spacing along the longitudinal axis of the mating surface 14. In an alternate spacing akin to FIG. 3, the dowels 18 and holes 22 have a matching regular spacing along a diagonal line upon the mating surface 14.

Typically, the axle straightening press 10 operates in many environments such as a basement workshop, a garage, trackside, and the like. To utilize the two separate jaw embodiment, a Cub Scout cleans off burrs and dust from the axle with sandpaper. The Cub Scout then marks the axle head with a dot off center to track rotation of the axle. Grasping the assembled male jaw 12 and female jaw 20, the Cub Scout inserts the dowels 18 to position the male jaw 12 with the female jaw 20 tightly. Then the Cub Scout places the axle in the channel formed between the male jaw 12 and the female jaw 20. The dot is at the top, 12 o'clock position. Placing the assembled press 10 upon a solid surface, the Cub Scout strikes the press 10 a few times with a hammer. Next, the Cub Scout rotates the axle to at least two positions from the 12 o'clock position and repeats the placement and hammering of the press 10. After hammering the press 10 with the axle in at least two positions, the Cub Scout strikes the head of the axle, squaring the head to the axle. The Cub Scout then removes the axle from the press 10 and polishes the axle as desired.

Figure 6:
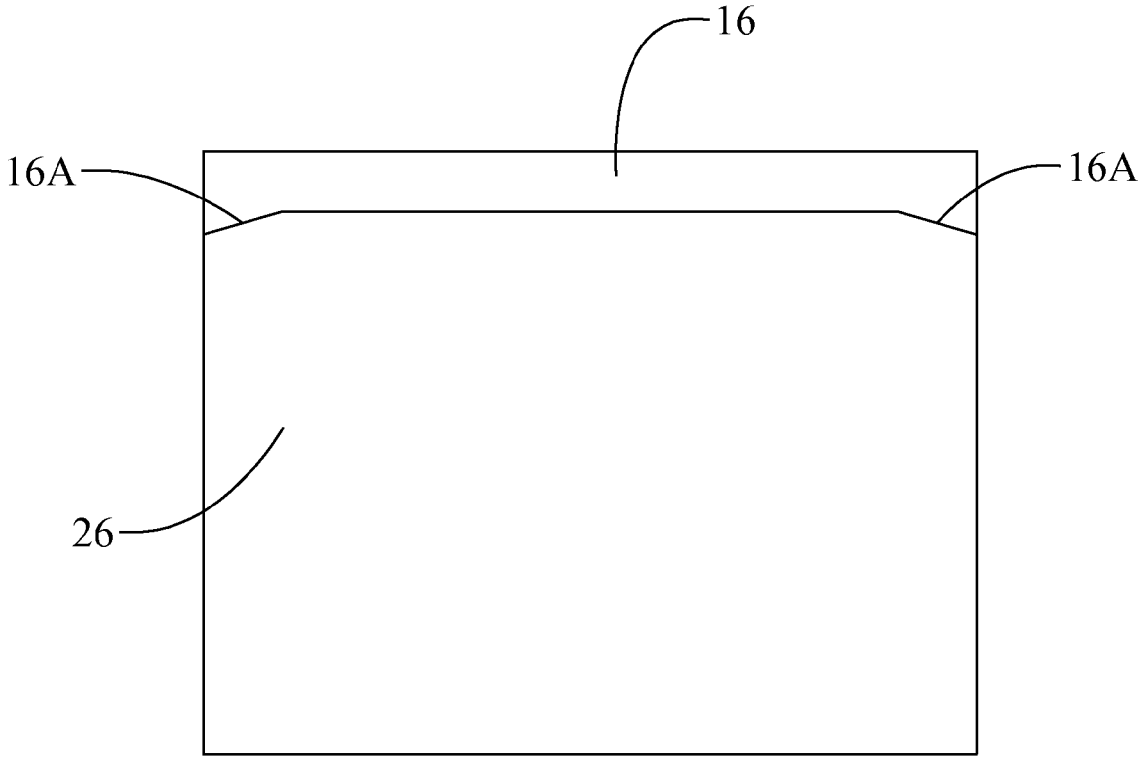

To use the preferred embodiment, a Cub Scout marks the axle head as before. The Cub Scout places the dowel 18 of one jaw 26 into the hole 22 of a second jaw 26 so the half channels 16 align. Grasping the assembled jaws 26, the Cub Scout brings the jaws 26 together and places the axle in the channel formed between the jaws 26. As described above, the dot is at the top, 12 o'clock position. Placing the assembled press 10 upon a solid surface, the Cub Scout strikes the press 10 a few times with a hammer. After hammering the press 10 with the axle in at least two positions, the Cub Scout strikes the head of the axle, forcing the head into the flare 16*a*. The flare shapes the head into a cone with the apex of the cone towards the axle thus minimizing contact of the head with the wheel. The flare, similar to a countersink, is shown in FIG. 6 where each end of a half channel has a flare so the jaws can be made identical and pairs of them combined for use as a hand tool press. Less contact of the head reduces friction and increases the speed of the wheel and then a car. The Cub Scout then removes the axle from the press 10 and polishes the axle as desired.

While a preferred embodiment of the axle straightening press has been described in detail, it should be apparent that modifications and variations thereto are possible, all of which fall within the true spirit and scope of the invention. The axle straightening press and its various components may be manufactured from many materials including, but not limited to, ferrous and non-ferrous metals and their alloys, and composites. The preferred embodiment uses steel and rectangular cross sections in a plane perpendicular to the longitudinal axis of the invention for the two identical jaws. The preferred embodiment also uses steel cylinders of round cross section in a plane parallel to the mating surface for the dowels. With respect to the above description then, it is to be realized that the optimum dimensional relationships for the parts of the invention, to include variations in size, materials, shape, form, function and manner of operation, assembly and use, are deemed readily apparent, and all equivalent relationships to those illustrated in the drawings and described in the specification are intended to be encompassed by the present invention. For example, any suitable sturdy material such as metal, plastic, or composite may be used instead of the steel dowels described. Also, the mating surface may be plated with a heavy-duty metal, composite or ceramic.

From the aforementioned description, an axle straightening press has been described, particularly one with identical jaws of simple manufacture. The axle straightening press is uniquely capable of straightening axles for wheels with only a hammer and minimal risk of injury.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A press to straighten solid axles of model cars by blows from a hand tool, comprising:

two mutually cooperating identical jaws, each of said jaws having a rectangular shape, a thickness, a longitudinal axis and a lateral axis perpendicular to said longitudinal axis, a mating surface, a centered half channel transverse upon said mating surface, said half channel having two opposite flared ends oriented in the direction of the blows from a hand tool, the diameter of said half channel being less than one twelfth of the thickness of said jaw, one dowel extending above and perpendicular to said mating surface, one hole extending perpendicular to and completely through said jaw and into said mating surface;

each of said dowels having a length above said mating surface approximately that of said thickness of said jaw, and a smooth cylindrical shape with a flat end rounded upon the perimeter opposite said mating surface fitting into one of said holes;

said holes having a smooth cylindrical shape to contain said dowel;

said dowel and said hole of each of said jaws being symmetrically arranged along the longitudinal axis of said mating surface and equally spaced away from said half channel; and, said dowel of one of said jaws aligning with said hole of the other of said jaws, said jaws closing together, and said half channels cooperatively confining an axle inserted through one of said flared ends.

2. The axle press of claim 1 further comprising:

each of said jaws having a thickness less than 0.75 inch.

3. The axle press of claim 2 wherein said jaws are steel.

4. A press to straighten solid axles of model cars by blows from a hand tool where each axle has a head upon one end, said press having two mutually cooperating identical steel jaws, each of said jaws having a rectangular shape, a thickness less than 0.75 inches, a longitudinal axis and a lateral axis perpendicular to said longitudinal axis, a mating surface, a centered half channel transverse upon said mating surface, one dowel extending above and perpendicular to said mating surface, said dowel having a length above said mating surface approximately that of said thickness of said jaw, one hole extending perpendicular to and completely through said jaw and into said mating surface, each of said dowels having a smooth cylindrical shape with a flat end rounded upon the perimeter opposite said mating surface fitting into one of said holes having a smooth cylindrical shape to contain said dowel, said dowel and said hole of each of said jaws being symmetrically arranged along the longitudinal axis of said mating surface and equally spaced away from said half channel, and said dowel of one of said jaws aligning with said hole of the other of said jaws, said jaws closing together, and said half channels cooperatively confining an axle, wherein the improvement comprises:

the diameter of said half channels being less than one twelfth of the thickness of said jaws; and, each of said half channels having two opposite flared ends wherein one of said flared ends of each of said jaws cooperate to fold inwardly said head of said axle into a cone wherein said head folds in the direction of the blows from a hand tool.

* * * * *